US009795525B2

(12) United States Patent
Lauret et al.

(10) Patent No.: US 9,795,525 B2
(45) **Date of Patent: *Oct. 24, 2017**

(54) FOLDABLE WHEELCHAIR FRAME INCLUDING A SELF LOCKING DEVICE

(71) Applicant: Invacare International Sarl, Gland (CH)

(72) Inventors: Aurelie Lauret, Lignieres de Touraine (FR); Christian Jouannet, Fondettes (FR); Wilfrid Da Cunha, Druye (FR); Jean-Michel Roncin, Tours (FR)

(73) Assignee: INVACARE INTERNATIONAL SARL, Gland (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/479,799

(22) Filed: Apr. 5, 2017

(65) Prior Publication Data

US 2017/0202716 A1 Jul. 20, 2017

Related U.S. Application Data

(62) Division of application No. 14/418,091, filed as application No. PCT/IB2012/053910 on Jul. 31, 2012, now Pat. No. 9,642,756.

(51) Int. Cl.
*A61G 5/08* (2006.01)

(52) U.S. Cl.
CPC ..... *A61G 5/08* (2013.01); *A61G 5/0816* (2016.11); *A61G 5/0883* (2016.11)

(58) Field of Classification Search
CPC ..... A61G 5/08; A61G 2005/0816; A61G 2005/0825; A61G 2005/0883; A61G 2005/0841; A61G 2005/0858
See application file for complete search history.

(56) References Cited

U.S. PATENT DOCUMENTS 2,639,162 A * 5/1953 Schon ..... B62B 7/08 280/42
4,712,830 A * 12/1987 Charbrol ..... A61G 5/08 280/42

(Continued)

*Primary Examiner* — Hau Phan
*Assistant Examiner* — Jacob Meyer
(74) *Attorney, Agent, or Firm* — Calfee, Halter & Griswold LLP

(57) ABSTRACT

A foldable wheelchair frame includes two side frame components, respectively a left and a right side frame components, each mounting front and rear wheels. The side frame components being connected together for relative folding movement between an erected position and a folded position by a foldable link extending between the two side frame components. The foldable link includes at least one central strut disposed between the two side frame components and connected to each side frame component by at least two connecting arms. First left and a second left connecting arms are connected to the left side frame component, and first right and second right connecting arms are connected to the right side frame component. Each of the connecting arms being pivotally connected at one end to one of the side frames and at one other end to the central strut such that the side frame components move closer to each other and the central strut moves along a longitudinal direction when the wheelchair frame moves from its erected position to its folded position. The central strut has at least one locking element that defines at least one left abutment (26*a*), respectively one right abutment, against which abuts a left locking pin (27*a*), respectively a right locking pin, protruding from the lower or upper face of one of the first left and the second left, respectively the first right and the second right, connecting arms in a vertical direction, when the wheelchair is in its erected position.

18 Claims, 8 Drawing Sheets

(56) References Cited

U.S. PATENT DOCUMENTS

| | | | | |
|---|---|---|---|---|
| 4,934,722 | A * | 6/1990 | Goetzelman | A61G 5/08 280/250.1 |
| 6,186,252 | B1 * | 2/2001 | Schaffner | A61G 5/043 180/65.1 |
| 6,467,788 | B1 * | 10/2002 | Li | A61G 5/08 280/304.1 |
| 6,572,133 | B1 * | 6/2003 | Stevens | A61G 5/08 280/250.1 |
| 8,419,047 | B2 * | 4/2013 | Chen | A61G 5/08 280/639 |
| 8,454,048 | B1 * | 6/2013 | Regan | A61G 5/08 280/646 |
| 2002/0093156 | A1 * | 7/2002 | Stevens | A61G 5/08 280/42 |

* cited by examiner

FOLDABLE WHEELCHAIR FRAME INCLUDING A SELF LOCKING DEVICE

RELATED APPLICATIONS

The present application is a continuation of U.S. patent application Ser. No. 14/418,091, filed on Apr. 15, 2015, which is the U.S. national phase entry of PCT/IB2012/053910, filed on Jul. 31, 2012, whereby the content of each application is incorporated herein by reference.

TECHNICAL FIELD

The present invention relates in general to foldable wheelchairs. More particularly, the present invention relates to a foldable wheelchair frame including a self locking device.

PRIOR ART AND THE PROBLEM UNDERLYING THE INVENTION

Foldable wheelchairs have been known for some time, and the advantages are numerous with respect to managing the wheelchair when it is not in use, or for transportation of the wheelchair.

Traditionally, foldable wheelchairs include frames provided with locking systems. These locking systems are designed to lock the frame in a fully erected position corresponding to the position of use of the wheelchair. However, the problem with such frames is often the difficulty for the user to easily access to the locking systems when he wants to move the wheelchair frame from this fully erected position to a fully folded position in which the wheelchair can be easily transported. Thus, a first objective of the present invention is to provide a foldable wheelchair frame which can be folded without requiring the handling of locking systems.

A second objective of the present invention is to provide a foldable wheelchair frame that can be easily and quickly folded and erected.

A third objective of the present invention is to provide a foldable wheelchair frame that can be locked both in a folded position and in an erected position.

SUMMARY OF INVENTION

In an aspect, the present invention provides a foldable wheelchair frame comprising two side frame components, respectively a left and a right side frame components, each mounting front and rear wheels, said side frame components being connected together for relative folding movement between an erected position and a folded position by foldable link means extending between said two side frame components, wherein the foldable link means comprises at least one central strut disposed between said two side frame components and connected to each side frame component by at least two connecting arms, respectively a first left and a second left connecting arms connected to the left side frame component and a first right and a second right connecting arms connected to the right side frame component, each of said connecting arms being pivotally connected at one end to one of said side frames and at one other end to said central strut such that said side frame components move closer to each other and said central strut moves along a longitudinal direction when the wheelchair frame moves from its erected position to its folded position, and wherein said central strut comprises at least one locking element, said locking element defining at least one left abutment, respectively one right abutment, against which abuts a left locking pin, respectively a right locking pin, protruding from the lower or upper face of one of said first left and said second left, respectively said first right and said second right, connecting arms in a vertical direction, when the wheelchair is in its erected position and wherein the pivot axes around which are pivotally connected the first left and right, respectively the second left and right, pairs of connecting arms to the central strut are positioned, in the erected position of the wheelchair frame, frontward relative to the vertical plane going through the pivot axes around which are pivotally connected said pairs of connecting arms to the left and right side frame components, thus securing the wheelchair frame in its erected position.

Further aspects and preferred embodiments are provided in the appended claims.

BRIEF DESCRIPTION OF THE DRAWINGS

The wheelchair frame of the present invention will be described in further detail further below, when useful with reference to the attached drawings, which show an exemplary wheelchair frame according to the invention.

DETAILED DESCRIPTION OF THE PREFERRED EMBODIMENTS

For the purpose of the present specification, situations and directions of elements of the wheelchair of the present invention arc determined by the perspective of a user seated in the wheelchair. Accordingly, the left side of the wheelchair corresponds to the right side of FIG. 1. The situations or directions "up" or "top" and "down" or "bottom", "rear" or "back" and "front", "behind" and "in front", "upper" and "lower", "lateral" and "central" follow the same rule. A longitudinal direction corresponds to a back-to-front direction and a lateral direction corresponds to a left-to-right direction. The horizontal corresponds to the plane tangential to the rear and front wheels and positioned under said wheels when the wheelchair is its normal position of use. A horizontal plane corresponds to a plane parallel to the horizontal. The vertical, or a vertical plane, corresponds to a plane perpendicular to the horizontal.

Figure 1:
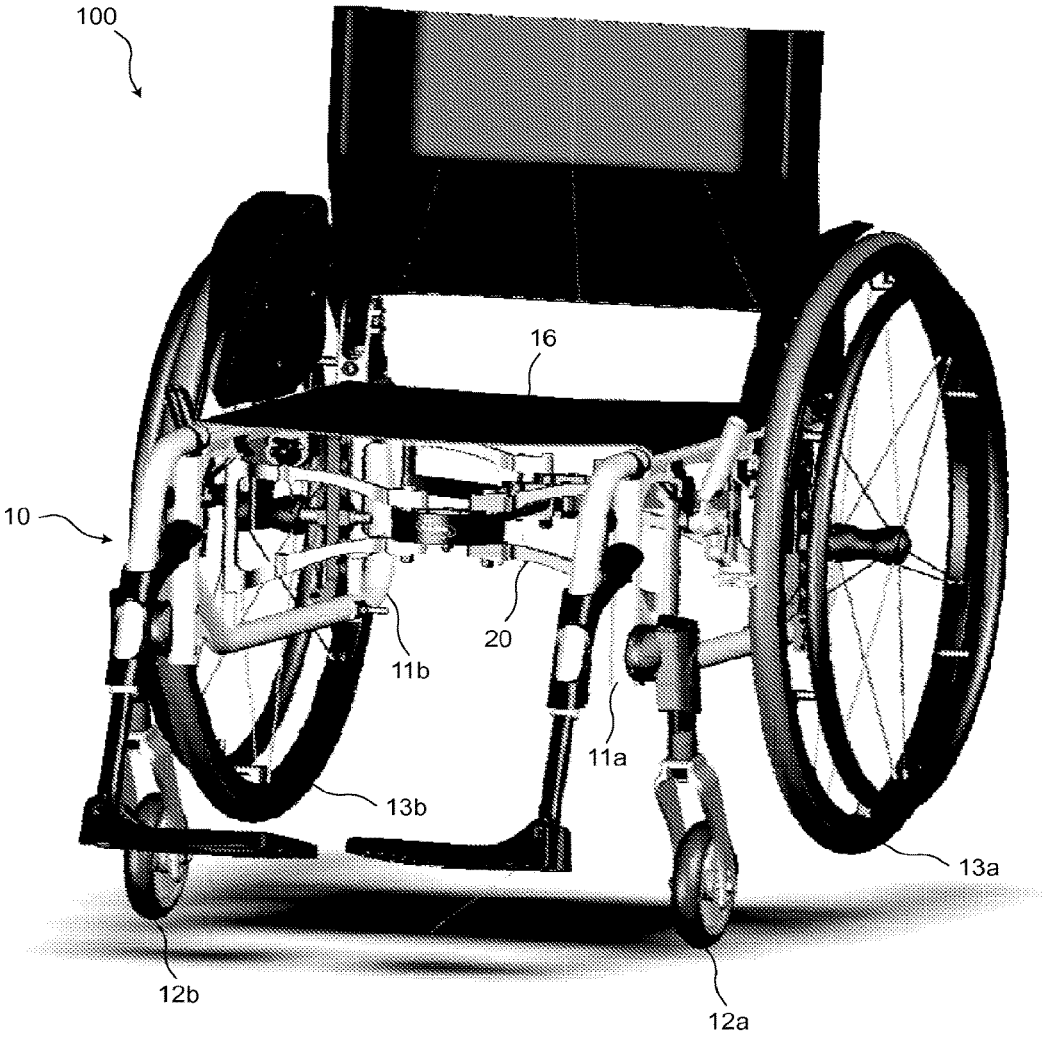
FIG. 1 is a perspective view of a wheelchair including a wheelchair frame according to the present invention, said wheelchair being in its position of use.

FIG. 1 shows a foldable wheelchair according to the present invention. This wheelchair may be a dismountable wheelchair, meaning that at least a part of the wheelchair can be reversibly removed from the wheelchair. In this way, it is possible to remove at least one part, for example for the purpose of repairing the part or in order to arrange the wheelchair in a more space-saving manner, for example for storage and/or transport of the wheelchair. Thus, any one selected from the seat, the backrest, the armrest, the legrest may be demountable and remountable. The wheelchair 100 of FIG. 1 includes a frame 10 with front and rear wheels 12*a*, 13*a* and 12*b*, 13*b*, respectively, extending downwardly therefrom for engaging the ground. The frame 10 includes a left side component 11*a* and a right side component 11*b* connected together via a foldable link means 20. With reference to FIG. 2*e*, the left side component 11*a* comprises an upright 14*a*, an L-shaped bar 15*a* and a horizontal crossbar 16*a* extending therebetween. The right side component 11*b* is identical to the left side component 11*a*. A seating structure 16 extends between the left and the right side components 11*a*, 11*b*. The frame 10 is preferably made up of a lightweight high-strength material, such as aluminium.

Figure 2B:
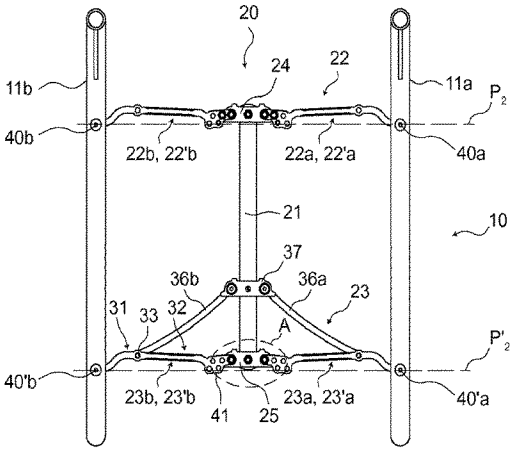
FIG. 2*b* is a view from below of the wheelchair frame as shown in FIG. 2*a*.
Figure 2A:
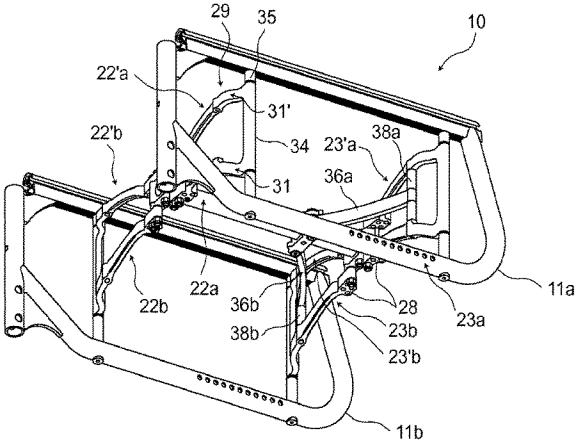
FIG. 2*a* is a perspective view of a wheelchair frame according to a first embodiment of the present invention, when locked in its erected position.
Figure 2E:
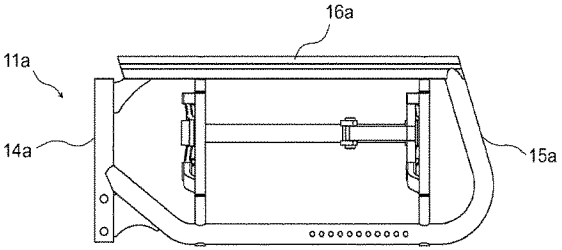
FIG. 2*e* is a side view of the wheelchair frame of FIG. 2*a*.
Figure 2D:
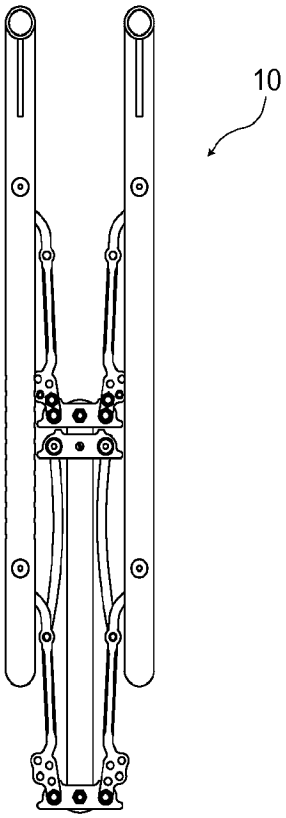
FIG. 2*d* is a view from below of the wheelchair frame as shown in FIG. 2*c*.
Figure 2C:
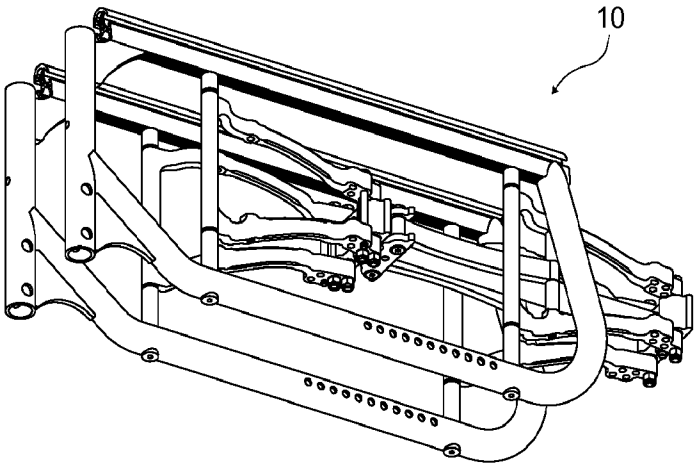
FIG. 2*c* is a perspective view of the wheelchair frame of FIG. 2*a*, when locked in its folded position.
Figure 3B:
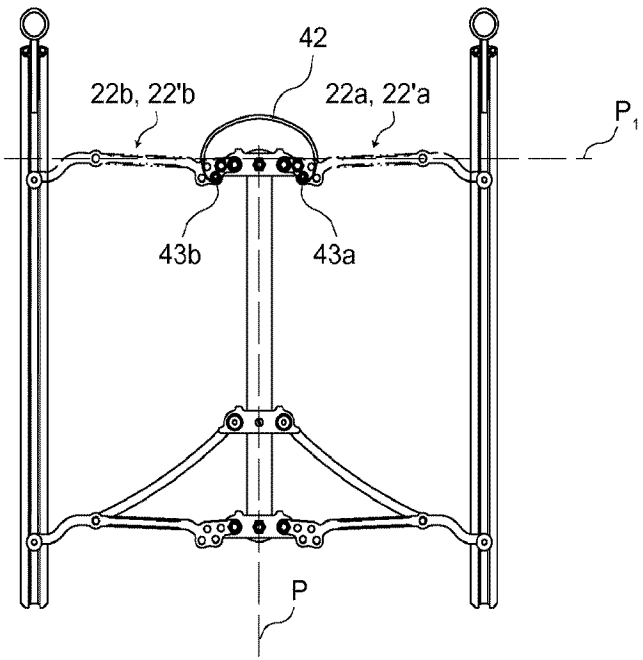
FIG. 3*b* is a view from below of the wheelchair frame as shown in FIG. 3*a*.
Figure 3A:
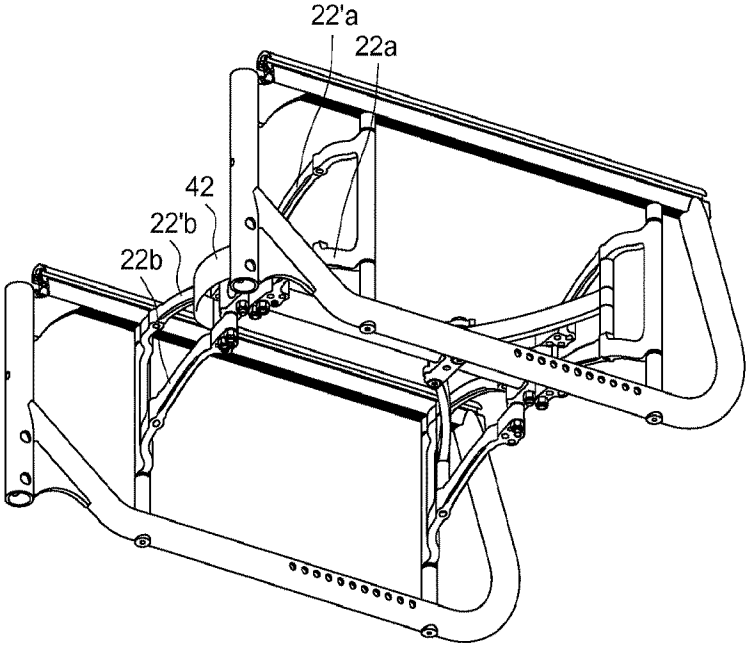
FIG. 3*a* is a perspective view of a wheelchair frame according to a second embodiment of the present invention, when locked in its erected position
Figure 3D:
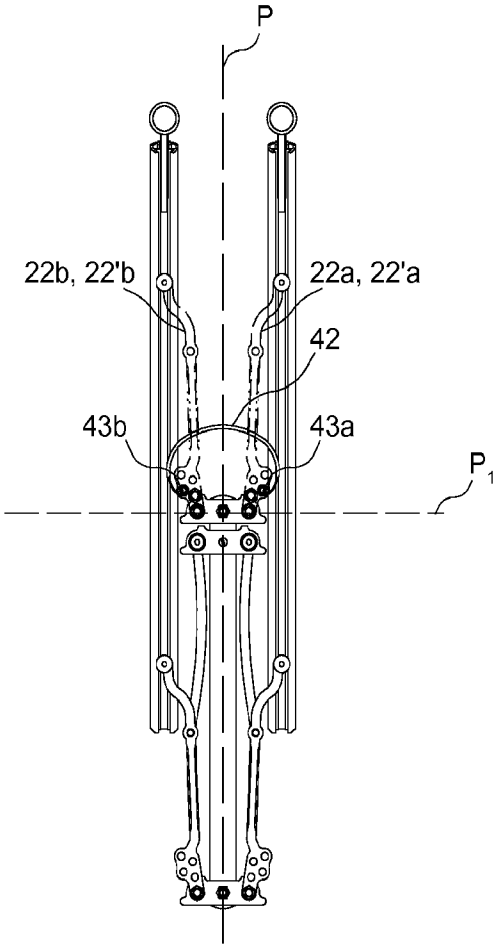
FIG. 3*d* is a view from below of the wheelchair frame as shown in FIG. 3*c*.
Figure 3C:
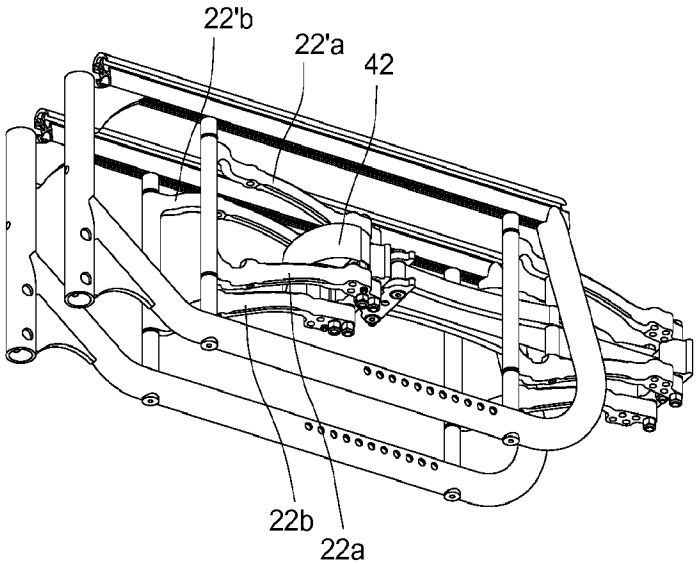
FIG. 3*c* is a perspective view of the wheelchair frame of FIG. 3*a*, when locked in its folded position.
Figure 4B:
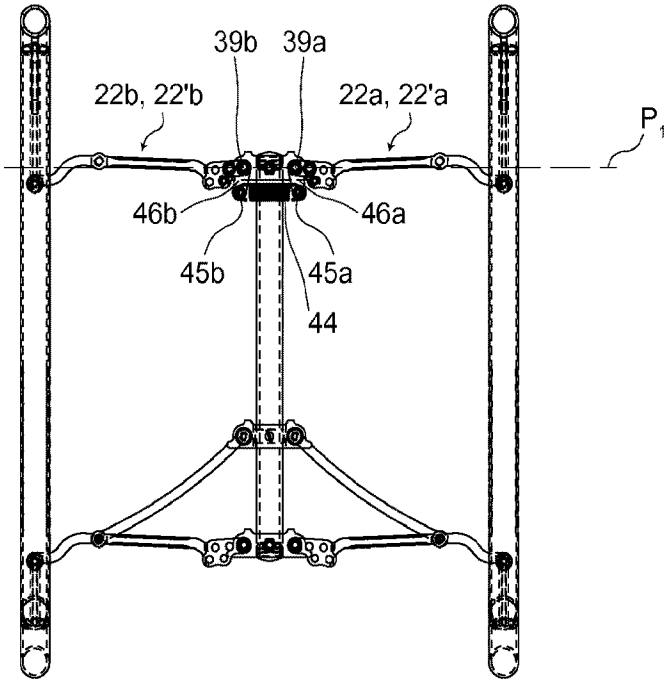
FIG. 4*b* is a view from below of the wheelchair frame as shown in FIG. 4*a*.
Figure 4A:
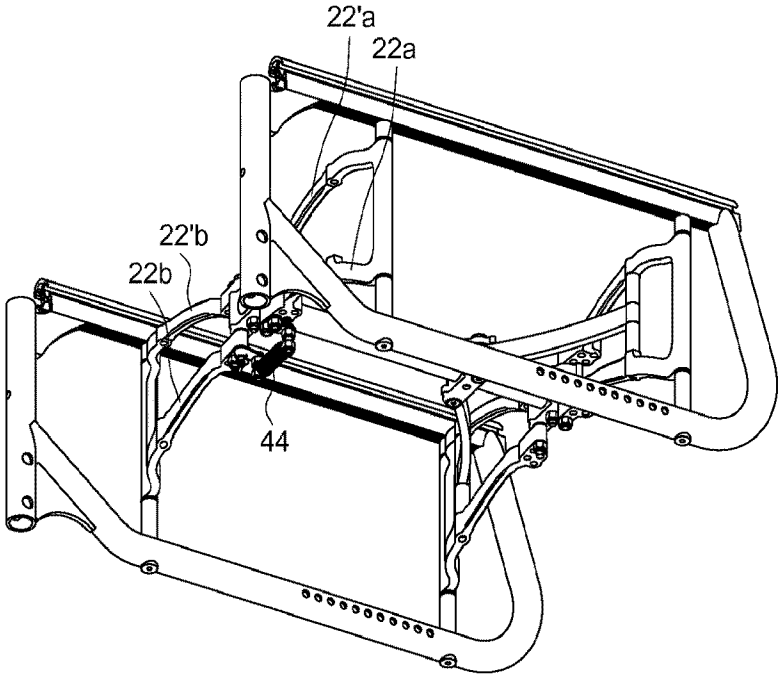
FIG. 4*a* is a perspective view of a wheelchair frame according to a third embodiment of the present invention, when locked in its erected position
Figure 4D:
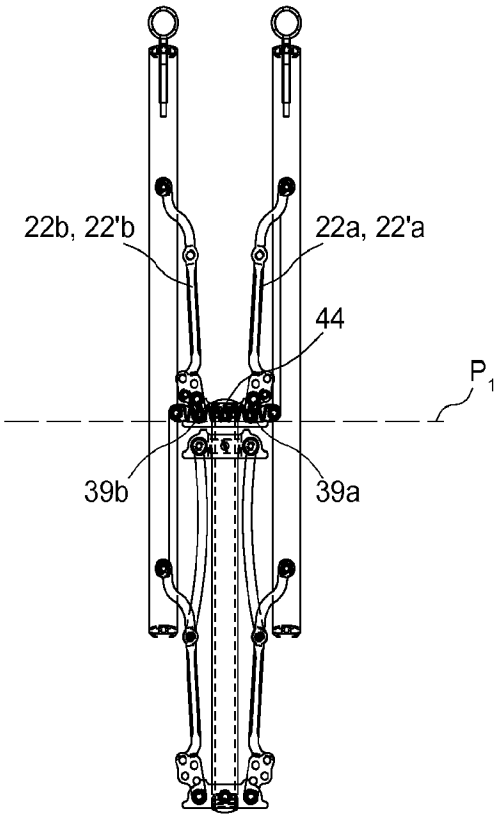
FIG. 4*d* is a view from below of the wheelchair frame as shown in FIG. 4*c*.
Figure 4C:
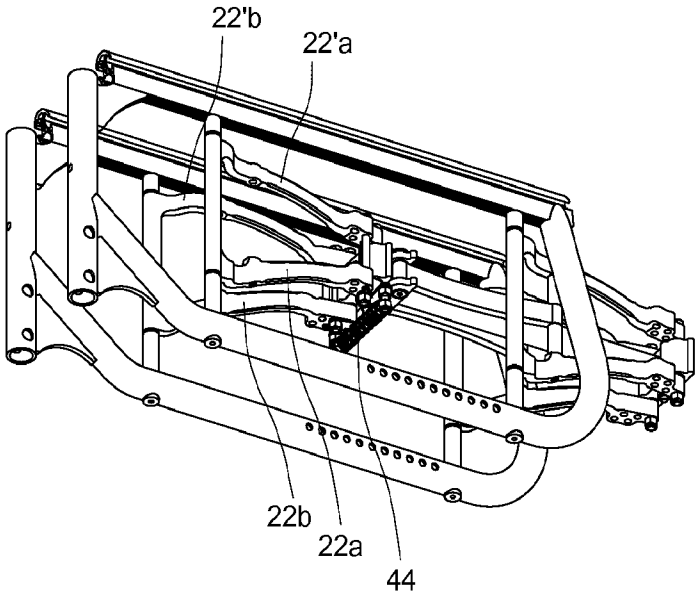
FIG. 4*c* is a perspective view of the wheelchair frame of FIG. 4*a*, when locked in its folded position.

As shown in FIGS. 2*a* and 2*b*, the foldable link means 20 can be deployed into an extended position to maintain the wheelchair frame 10 into an erected position and, as shown in FIGS. 2*c* and 2*d*, can be collapsed to bring the left and right side components 11*a* and 11*b* into close proximity, thus maintaining the wheelchair frame 10 into a folded position.

In the embodiment shown, the foldable link means 20 consists in an articulated structure comprising a central strut 21 extending in a longitudinal direction and disposed between and parallel to the left and right side components 11*a*, 11*b*, said central strut being connected thereto by a first pair of front left and right wings 22 and by a second pair of rear left and right wings 23, said first pair and said second pair being longitudinally spaced-apart. Each wing 22 or 23 consists in a pair of connecting arms, respectively a first, or front, lower and upper left connecting arms 22*a*, 22'*a* and a second, or rear, lower and upper left connecting arms 23*a*, 23'*a* connected to the left side frame component 11 a and a first, or front, lower and upper right connecting arms 22*b*, 22'*b* and a second, or rear, lower and upper right connecting arms 23*b*, 23'*b* connected to the right side frame component 11*b*, each of said connecting arms being pivotally connected at one proximal end to the left or right side frame components 11*a*, 11*b* and at one distal end to the central strut 21. Thus configured, the foldable link means 20 permits to move the wheelchair frame 10 from the erected position illustrated in FIGS. 2*a* and 2*b*, in which the left and right side frame components 11*a*, 11*b* are laterally spaced-apart, to the folded position illustrated in FIGS. 2*c* and 2*d*, in which the left and right side frame components 11*a*, 11*b* are in close proximity. During the folding operation of the wheelchair frame, the central strut 21 moves along a longitudinal direction, rearward, as illustrated in the embodiment shown, or frontward, in a further embodiment not shown, relative to the left and right side frame components 11*a*, 11*b*.

Furthermore, to easily fold the wheelchair frame, each connecting arm may advantageously be articulated around a pivot axle 33 and comprises a proximal part 31 pivotally connected to the left or right side frame component 11*a*, 11*b* and a distal part 32 pivotally connected to the central strut 21, said proximal part and said distal part being pivotally connected together around said vertical axle. In the specific embodiment shown, the proximal parts of the first lower and upper left, and, respectively, of the second lower and upper left, and, respectively, of the first lower and upper right, and, respectively, of the second lower and upper right, connecting arms are linked by a vertical flange 34 so as to form a single U-shape piece 29, said U-shape piece being pivotally connected to a vertical crosspiece 35 extending between the L-shaped bar 15*a* and the horizontal crossbar 16*a* of the left or right side frame component 11*a*, 11*b*.

Furthermore, to maintain a symmetrical position of the left and right side frame components 11*a*, 11*b* relative to the central strut 21 during the folding operation of the wheelchair frame 10, the foldable link means 20 comprises also a guiding element 37 slidably movable along the central strut 21, said guiding element being linked to the second pair of rear left and right wings 23 through a left lever arm 36*a* and a right lever arm 36*b*, said left lever arm 36*a*, respectively said right lever arm 36*b*, being pivotally connected at one end to said guiding element 37 and at the other end to a vertical crossbar 38*a*, respectively 38*b*, extending between the second lower and upper left connecting arms 23*a*, 23'*a*, respectively the second lower and upper right connecting arms 23*b*, 23'*b*. In the embodiment shown, the vertical crossbar 38*a*, respectively 38*b*, is advantageously aligned with the vertical axle 33 around which is pivotally connected the proximal part 31 and the distal part 32 of the second lower and upper left connecting arms 23*a*, 23'*a*, respectively of the second lower and upper right connecting arms 23*b*, 23'*b*.

Figure 5:
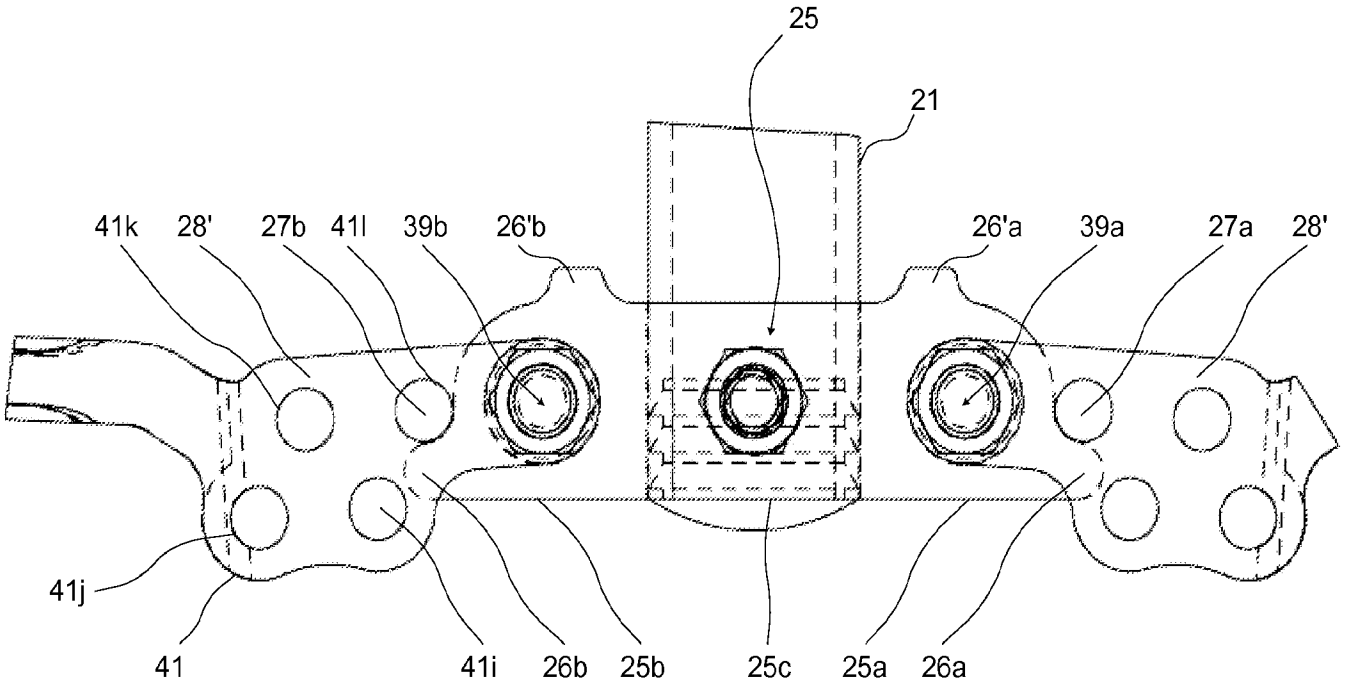
FIG. 5 is an enlarged view of the detail A identified in FIG. 2*b*.

The foldable link means 20 further comprises locking means so as to lock the wheelchair frame 10 in its erected and folded positions. In the embodiment shown, such locking means consist in a front locking element 24 and in a rear locking element 25 fixedly connected at both ends of the central strut 21 respectively. In a further embodiment of the invention (not shown), said front and rear locking elements 24, 25 may also be integral with the central strut 21. As illustrated in detail in FIG. 5, the rear locking element 25 comprises a left end portion 25*a* and a right end portion 25*b*, said left and right end portions 25*a*, 25*b* being linked by a central portion 25*c*. The left end portion 25*a*, respectively the right end portion 25*b*, has approximately a quarter-cylindrical form and the central portion 25*c* defines approximately a parallelepiped. The axis of the quarter-cylindrical form is advantageously aligned with the pivot axis 39*a*, for the left portion 25*a*, or the pivot axis 39*b*, for the right portion 25*b*, around which are pivotally connected the second lower and upper left connecting arms 23*a*, 23'*a*, respectively the second lower and upper right connecting arms 23*b*, 23'*b*, to the central strut 21. Furthermore, the left end portion 25*a*, respectively the right end portion 25*b*, comprises two radially protruding parts 26*a*, 26'*a*, respectively 26*b*, 26'*b*, said protruding parts being angularly spaced-apart along the periphery of the locking element 25 and defining a first left and a second left, respectively a first right and a second right, abutments against which abuts a left locking pin 27*a*, respectively a right locking pin 27*b*, extending vertically between and fixedly connected to the second lower and upper left connecting arms 23*a*, 23'*a*, respectively the second lower and upper right connecting arms 23*b*, 23'*b*. Thus, in the erected position of the wheelchair frame 10, the left and right locking pins 27*a*, 27*b* abut respectively against the first left and right abutments 26*a*, 26*b* and, in the folded position of the wheelchair frame 10, the left and right locking pins 27*a*, 27*b* abut respectively against the second left and right abutments 26'*a*, 26'*b*. The front locking element 24 is identical to the rear locking element 25.

Furthermore, so as to secure the wheelchair frame in its erected position, the pivot axes 39*a* and 39*b* may advantageously be positioned, in the erected position of the wheelchair frame, frontward relative to the vertical plane P2, respectively P'2, going through the pivot axes 40*a* and 40*b*, respectively 40'*a* and 40'*b*, around which are pivotally connected the front left and right wings 22, respectively the rear left and right wings 23, to the left and right side frame components 11*a* and 11*b*. Indeed, during the normal use of the wheelchair, the weight of the user exerts a downward oriented strength on the central portion of the flexible seat 16, which generates a deformation of the scat. Thus configured, the scat 16 exerts an internally laterally oriented strength on the side frame components 11*a*, 11*b*, which favours the movement of the wheelchair frame 10 from its erected position to its folded position. However, to prevent or at least limit the risk of an accidental folding of the wheelchair frame in its erected position, the invention proposes to position the pivot axes 39*a* and 39*b* frontward relative to an unstable balance position in which the efforts required to fold the wheelchair frame are substantially equal to the efforts exerted by the seat. Technical studies have shown that this unstable balance position correspond the specific configuration of the wheelchair frame in which the pivot axes 39*a* and 39*b* are positioned in the plane P2 or P'2. Thus, in positioning the pivot axes 39*a* and 39*b* frontward relative to said plane P2 or P'2, the efforts exerted by the seat can not generate a folding of the wheelchair frame in its erected position.

Furthermore, so as to allow small changes in the configuration of the wheelchair frame in its erected and/or folded position, in particular so as to modify the position of the locking pins 27*a* and 27*b*, a distal end 41 of each connecting arm is advantageously provided with a plurality of vertical through-holes 41*i*, 41*j*, 41*k*, 41*l*, two of said through-holes, respectively the through-holes 41*k* and 41*l*, being adapted to receive the left or the right locking pins 26*a*, 26*b*, 26'*a* or 26'*b*.

Furthermore, so as to secure the wheelchair frame in its erected or folded position, the foldable link means 20 may advantageously comprise safety means adapted to maintain the left and/or right locking pin 27*a*, 27*b* in contact with the corresponding abutments of the locking element 24 or 25.

In the embodiment illustrated in FIGS. 3*a* to 3*d*, the safety means consists in an arc-shaped leaf spring 42 attached at one end to a left anchoring rod 43*a* extending between and fixedly connected to the first lower and upper left connecting arms 22*a*, 22'*a* and at the other end to a right anchoring rod 43*b* extending between and fixedly connected to the first lower and upper right connecting arms 22*b*, 22'*b*. The left anchoring rod 43*a*, respectively the right anchoring rod 43*b*, may advantageously be received in one of the through-holes 41*i* and 41*j* provided in the distal end 41 of the first lower and upper left connecting arms 22*a*, 22'*a*, respectively the first lower and upper right connecting arms 22*b*, 22'*b*. In the preferred embodiment shown, said first lower and upper left connecting arms 22*a*, 22'*a* and said first lower and upper right connecting arms 22*b*, 22'*b* may advantageously be sensitively symmetrical with regard to the vertical plane P that goes through the center of the arc defined by the leaf spring 42, both into the erected and folded positions of the wheelchair frame 10. Indeed, such a configuration confers a great stability to the wheelchair frame 10. Furthermore, the leaf spring 42 may advantageously be configured so that the direction of the torque generated by the leaf spring 42 changes according to the position of the left and right anchoring rods 43*a*, 43*b* relative to the vertical plane P1 going through the pivot axes 39*a*, 39*b* around which are pivotally connected said first lower and upper left and right connecting arms 22*a*, 22'*a*, 22*b*, 22'*b* to the locking element 24. In particular, in the erected position of the wheelchair frame, the left anchoring rod 43*a*, respectively the right anchoring rod 43*b*, is positioned rearward with regard to the vertical plane P1. In this configuration, the torque generated by the leaf spring 42 is directed so as to bias the left and right locking pins 27*a*, 27*b* to move toward the first left and right abutments 26*a*, 26*b* respectively, thus maintaining the wheelchair frame in its erected position. On the contrary, in the folded position of the wheelchair frame, the left anchoring rod 43*a*, respectively the right anchoring rod 43*b*, is positioned frontward with regard to said vertical plane Pl. In this configuration, the torque generated by the leaf spring 42 is directed so as to bias the left and right locking pins 27*a*, 27*b* to move toward the second left and right abutments 26'*a*, 26'*b* respectively, thus maintaining the wheelchair frame in its folded position.

In the embodiment shown illustrated in FIGS. 4*a* to 4*d*, the safety means consists in a coil spring 44 attached at one end to a left anchoring rod 45*a* extending between and fixedly connected to the first lower and upper left connecting arms 22*a*, 22'*a* and at the other end to a right anchoring rod 45*b* fixedly connected to the first lower and upper right connecting arms 22*b*, 22'*b*. In the embodiment shown, the left anchoring rod 45*a*, respectively the right anchoring rod 45*b*, is received in a through-hole provided at one end of a linking plate 46*a*, respectively 46*b*, which is fixedly connected to the first lower and upper left connecting arms 22*a*, 22'*a*, respectively the first lower and upper right connecting arms 22*b*, 22'*b*, through a screw 46*a*, respectively 46*b*, which is received in one of the through-hole 41*i* and 41*j* provided in the distal end 41 of the first lower and upper left connecting arms 22*a*, 22'*a*, respectively the first lower and upper right connecting arms 22*b*, 22'*b*. In the preferred embodiment shown, the left, respectively the right, anchoring rod 45*a*, respectively 45*b*, is positioned, in the erected position of the wheelchair frame, rearward with regard to the vertical plane P1 that goes through the pivot axes 39*a*, 39*b* around which are pivotally connected said first lower and upper left and right connecting arms 22*a*, 22'*a*, 22*b*, 22'*b* to the locking element 24, thus biasing the left and right locking pins 27*a*, 27*b* to move toward the first left and right abutments 26*a*, 26*b* respectively, and, in the folded position of the wheelchair frame, frontward with regard to said vertical plane P1, thus biasing the left and right locking pins 27*a*, 27*b* to move toward the second left and right abutments 26'*a*, 26'*b* respectively.

In a further embodiment (not shown), the safety means consists in at least one magnet disposed at the periphery of the locking element 24 so as to be in contact with a metallic part of the left and/or the right locking pin 27*a*, 27*b* in the erected and/or folded position of the wheelchair frame.

In a further embodiment (not shown), the safety means consists in at least one magnet disposed at the periphery of the left or the right locking pin 27*a*, 27*b* so as to be in contact with a metallic part of the locking element 24 in the erected and/or folded position of the wheelchair frame.

The above detailed description with reference to the drawings illustrates rather than limit the invention. There are numerous alternatives, which fall within the scope of the appended claims.

In particular, in a further embodiment (not shown), each wing 22 and 23 illustrated in FIGS. 1, 2*a*-2*e*, 3*a*-3*d*, 4*a*-4*d* may be replaced by a single connecting arm. In this case, the left and the right locking pins 27*a*, 27*b* may protrude in a vertical direction from the lower or upper face 28 or 28'of said connecting arms.

The invention claimed is:

1. A foldable wheelchair frame comprising two side frame components, respectively a left and a right side frame components, each mounting front and rear wheels, said side frame components being connected together for relative folding movement between an erected position and a folded position by foldable link means extending between said two side frame components, wherein the foldable link means comprises at least one central strut disposed between said two side frame components and connected to each side frame component by at least two connecting arms, respectively a first left and a second left connecting arms connected to the left side frame component and a first right and a second right connecting arms connected to the right side frame component, each of said connecting arms being pivotally connected at one end to one of said side frames and at one other end to said central strut such that said side frame components move closer to each other and said central strut moves along a longitudinal direction when the wheelchair frame moves from its erected position to its folded position, and wherein said central strut comprises at least one locking element, said locking element defining a first left and a second left abutments, respectively a first right and a second right abutments, against which abuts a left locking pin, respectively a right locking pin, protruding from the lower or upper face of one of said first left and said second left, respectively said first right and said second right, connecting arms in a vertical direction, said first left abutment, respectively said first right abutment, corresponding to the erected position of the wheelchair frame and said second left abutment, respectively said second right abutment, corresponding to the folded position of the wheelchair frame.

2. The wheelchair frame of claim 1, wherein said at least one central strut is connected to each side frame component by at least two pairs of connecting arms, respectively a first lower and upper left and a second lower and upper left connecting arms connected to the left side frame component and a first lower and upper right and a second lower and upper right connecting arms connected to the right side frame component, each of said connecting arms being pivotally connected at one end to one of said side frames and at one other end to said central strut such that said side frame components move closer to each other and said central strut moves along a longitudinal direction when the wheelchair frame moves from its erected position to its folded position, and wherein said central strut comprises at least one locking element, said locking element defining a first left and a second left abutments, respectively a first right and a second right abutments, against which abuts a left locking pin, respectively a right locking pin, extending in a vertical direction between said first lower and upper left or between said second lower and upper left, respectively between said first lower and upper right or between said second lower and upper right, connecting arms, said first left abutment, respectively said first right abutment, corresponding to the erected position of the wheelchair frame and said second left abutment, respectively said second right abutment, corresponding to the folded position of the wheelchair frame.

3. The wheelchair frame of claim 1, wherein each of said connecting arms is articulated around a vertical axle and comprises a proximal part pivotally connected to one of said side frame components and a distal part pivotally connected to said central strut, said proximal part and said distal part being pivotally connected together around said vertical axle.

4. The wheelchair frame of claim 3, wherein the proximal parts of the first lower and upper left connecting arms, and/or the proximal parts of the second lower and upper left connecting arms, and/or the proximal parts of the first lower and upper right connecting arms, and/or the proximal part of the second lower and upper right connecting arms are respectively linked by a vertical flange so as to form a single U-shape piece, said U-shape piece being pivotally connected to a vertical crosspiece of one of the side frame component.

5. The wheelchair frame of claim 4, wherein the foldable link means comprises at least one left lever arm and one right lever arm, each of said at least one left and right lever arm being pivotally connected at one end to a guiding element slidably movable along the central strut and at the other end to a vertical crossbar extending between the first lower and upper left, or the second lower and upper left, or the first lower and upper right, or the second lower and upper right, connecting arms.

6. The wheelchair frame of claim 5, wherein the vertical crossbar is approximately aligned with the vertical axle around which is pivotally connected the proximal part and the distal part of a connecting arm.

7. The wheelchair frame of claim 1, wherein the locking element comprises a left end portion, respectively a right end portion, said left end portion, respectively said right end portion, having approximately a quarter-cylindrical form, the axis of said quarter-cylindrical form being aligned with the pivot axis around which is pivotally connected one of the connecting arms to the central strut and wherein the first left and the second left abutments, respectively the first right and the second right abutments, of the locking element are defined by two radially protruding parts of said left end portion, respectively said right end portion.

8. The wheelchair frame of claim 1, wherein a distal end of each connecting arm is provided with a plurality of vertical through-holes, said through-holes being adapted to receive the left or right locking pin so that the position of said locking pin can be modified, thus allowing small changes in the configuration of the wheelchair frame in its erected and/or folded position.

9. The wheelchair frame of claim 1, wherein the foldable link means further comprises safety means adapted to maintain the left and/or right locking pin in contact with the corresponding abutments of the locking element, thus maintaining the wheelchair frame in its erected or folded position.

10. The wheelchair frame of claim 9, wherein said safety means is an arc-shaped leaf spring attached at one end to a left anchoring rod fixedly connected to the first left, or the second left, connecting arm or pair of connecting arms and at the other end to a right anchoring rod fixedly connected to the first right, or a second right, connecting arm or pair of connecting arms, said first left and said first right, respectively said second left and said second right, connecting arms or pair of connecting arms being sensitively symmetrical with regard to the vertical plane going through the center of the arc defined by said leaf spring.

11. The wheelchair frame of claim 10, wherein the central strut is aligned with the vertical plane that goes through the center of the arc defined by the leaf spring.

12. The wheelchair frame of claim 10, wherein the leaf spring is configured so that the direction of the torque generated by said leaf spring changes according to the position of the left and right anchoring rods relative to the vertical plane going through the pivot axes around which are pivotally connected the first left and right, respectively the second left and right, connecting arms or pairs of connecting arms to the locking element.

13. The wheelchair frame of claim 12, wherein, when the left anchoring rod, respectively the right anchoring rod, is positioned rearward with regard to the vertical plane, the torque generated by the leaf spring is directed so as to bias the left and right locking pins to move toward the first left and right abutments respectively, thus maintaining the wheelchair frame in its erected position, and, when the left anchoring rod, respectively the right anchoring rod, is positioned frontward with regard to said vertical plane, the torque generated by the leaf spring is directed so as to bias the left and right locking pins to move toward the second left and right abutments respectively, thus maintaining the wheelchair frame in its folded position.

14. The wheelchair frame of claim 9, wherein said safety means is a coil spring attached at one end to a left anchoring rod fixedly connected to the first left, or the second left, connecting arm or pair of connecting arms and at the other end to a right anchoring rod fixedly connected to the first right, or the second right, connecting arm or pair of connecting arms, said left and right anchoring rods being positioned, in the erected position of the wheelchair frame, rearward with regard to the vertical plane going through the pivot axes around which are pivotally connected said first left and right, or said second left and right, connecting arms or pairs of connecting arms to the locking element, thus biasing the left and right locking pins to move toward the first left and right abutments respectively, and, in the folded position of the wheelchair frame, frontward with regard to said vertical plane (P1), thus biasing the left and right locking pins to move toward the second left and right abutments respectively.

15. The wheelchair frame of claim 9, wherein said safety means is at least one magnet disposed at the periphery of the locking element so as to be in contact with a metallic part of the left and/or the right locking pin in the erected and/or folded position of the wheelchair frame.

16. The wheelchair frame of claim 9, wherein said safety means is at least one magnet disposed at the periphery of the left or the right locking pin so as to be in contact with a metallic part of the locking element in the erected and/or folded position of the wheelchair frame.

17. The wheelchair frame of claim 1, wherein the pivot axes around which are pivotally connected the first left and right, respectively the second left and right, connecting arms or pairs of connecting arms to the central strut are positioned, in the erected position of the wheelchair frame, frontward relative to the vertical plane going through the pivot axes around which are pivotally connected said connecting arms or pairs of connecting arms to the left and right side frame components, thus securing the wheelchair frame in its erected position.

18. A wheelchair comprising a wheelchair frame according to claim 1.

* * * * *